US006269807B1

(12) United States Patent
Szadurski

(10) Patent No.: US 6,269,807 B1
(45) Date of Patent: Aug. 7, 2001

(54) HEAT STORAGE RANGE COOKER

(75) Inventor: Marek Szadurski, Sheffield (GB)

(73) Assignee: Trianco Redfyre Limited, Thorncliffe (GB)

( * ) Notice: Subject to any disclaimer, the term of this patent is extended or adjusted under 35 U.S.C. 154(b) by 0 days.

(21) Appl. No.: 09/484,570

(22) Filed: Jan. 18, 2000

(30) Foreign Application Priority Data

Feb. 10, 1999 (GB) ..... 9902805

(51) Int. Cl.[7] ..... F24C 15/10; F24C 15/32
(52) U.S. Cl. ..... 126/39 F; 126/21 R; 126/273 R
(58) Field of Search ..... 126/39 C, 39 F, 126/39 D, 39 H, 216, 276, 21 R, 21 A, 273 R

(56) References Cited

U.S. PATENT DOCUMENTS

| | | | | |
|---|---|---|---|---|
| 834,230 | * | 10/1906 | Blanchard | 126/216 |
| 1,513,357 | * | 10/1924 | Webber | 126/276 |
| 2,762,360 | * | 9/1956 | Knoy | 126/39 C |
| 3,375,819 | | 4/1968 | Davis | 126/211 |
| 3,651,796 | | 3/1972 | Nelson | 126/215 |
| 4,108,139 | * | 8/1978 | Gilliom et al. | 126/21 A |
| 4,431,889 | * | 2/1984 | Saponara et al. | 126/21 A |

FOREIGN PATENT DOCUMENTS

| | | | |
|---|---|---|---|
| 799 716 A | | 6/1936 | (FR) . |
| 1 219 265 A | | 5/1960 | (FR) . |
| 13337 | | 3/1916 | (GB) . |
| 588 797 A | | 3/1946 | (GB) . |
| 2289328 | * | 11/1995 | (GB) . |
| 2300475 | * | 11/1996 | (GB) . |

* cited by examiner

*Primary Examiner*—Sara Clarke
(74) *Attorney, Agent, or Firm*—Woodard, Emhardt, Naughton Moriarty & McNett

(57) ABSTRACT

The invention relates to the provision of a heat storage range cooker which includes a heat source mounted therein from which heating gas is emitted. The gas passes into a cavity which leads into two ducts, a first duct passing to heat a heating plate and a second duct leading to a heating oven and passing along at least the underside and one side wall of the same. The first duct can be directed past a second heating plate and, in one embodiment, the first and second ducts are joined at exit or are positioned adjacent one another to allow the exit of the gas from the ducts and cooker at a common location.

22 Claims, 3 Drawing Sheets

HEAT STORAGE RANGE COOKER

CROSS REFERENCE TO RELATED APPLICATIONS

This application claims priority of British Patent Application Serial No. 9902805.2, filed on Feb. 10, 1998, and entitled, "Heat Storage Range Cooker. "

BACKGROUND OF THE INVENTION

The invention to which this application relates is to a heat storage range cooker of a type which has an indirect heating source which is used to generate heat typically in at least one, but normally two, heating plates and in at least one but typically two heating ovens within the same cooker.

The heat storage range cooker is well known and has been a product which is known for having qualities which differ entirely from the direct heat style of cooker which use a number of burners each of which are independently controllable. The heat storage range cooker however, uses a single heat source which heat is directed via a heating "barrel" to heat heating plates, typically so that one plate is hotter than the other so that one causes heating or boiling of pans placed on the plate and the other is a simmering plate and at least two ovens, one of which is a baking oven and the other is a simmering oven. A problem with this type of cooker is however that the same are typically bulky, extremely heavy and require a flue to a point external of the premises so that typically the location of the cooker in a kitchen is restricted so as to be close to an external wall and in many instances, the cooker may not even be able to be installed in certain kitchens due the requirement to support the weight of the same. Furthermore, the installation of these type of cookers can be expensive and disruptive.

A further disadvantage is that this style of cooker, if it has been switched off and then subsequently switched on, take a considerable period of time, such as for example 10 to 12 hours to reach the required heat, and this means that either the cooker is switched on permanently for the same to be used whenever required, which is wasteful of fuel and is also uncomfortable in hot days or, alternatively, if the cooker is switched off then a significant degree of pre-planning is required so as to ensure that the cooker is switched on a sufficient time before it is required to be used.

BRIEF SUMMARY OF THE INVENTION

The aim of the present invention is to provide a heat storage range cooker which uses a principle of at least a single heat source but does so in a manner which allows the cooker to heat up within a relatively short period of time so as to allow the same to be switched on and off as and when required and be pre-programmable, and a further aim is to allow the location of the cooker to be selected by the requirements of the user of the cooker rather than by the requirements of the cooker itself.

In a first aspect of the invention there is provided a heat storage range cooker including a heat source mounted within the cooker which creates a heating gas in a cavity and characterised in that from said cavity there depends a first duct leading to a heating plate to channel heat thereto and a second duct leading to a heating oven to channel heat thereto, and said second duct passes along at least the underside and one sidewall of the said heating oven.

Preferably the ducts and hence the heating gas exit to atmosphere at said cooker.

Typically the second heating duct passes round the underside and the side wall of the oven furthest from the heat source and, on the near side wall of the heating oven there is provided a passage into which the heating gas can pass.

Typically the first duct passes to the heating plate and then continues past a second heating plate.

Typically the first and second ducts are arranged within the cooker so as to join together and/or be located so that the exits of the same are adjacent to allow the emission of the heating gas therefrom.

In one embodiment, the underside of the first heating plate is provided with at least one flute so as to aid heat transfer and/or the underside of the second heating plate is provided with at least one flute to improve heat transfer and/or also to determine the flow of the heating gas past the same to improve heating efficiency.

In a further feature the duct leading to the heating plate is also provided with a number of flutes to improve the heat exchange as the heating gas flows therealong.

In a further feature of the invention, there is provided at least one fan in connection with said heating duct or ducts, said fan operated to improve the flow of the heating gas through the same.

In a preferred embodiment, the fan is connected to the ducts so that, when operational, it creates a negative pressure of the gas within the duct. Typically to provide this feature the fan is connection to the exit or exits of the ducts. In an alternative embodiment, a positive pressure of gas is created within the ducts and to create this the fan is typically located at or adjacent to the heat source.

The provision of the fan means that a flue connected to the external equivalent of the premises is not required and so the location of the cooker is no longer restricted as the heating gases can exit directly into the kitchen. The fan acts to suck gases through the cooker and to dilute the products of combustion to below an acceptable level, for example, the products of combustion are reduced to between 2–4 ppm of carbon dioxide. Typically, prior to the exit of the heating gas, the same is mixed with air which has the effect of reducing the flow rate of the gas, to cool the gases before exit and to further dilute carbon monoxide levels.

In a further feature of the invention the side wall and/or the underside wall of the heating oven is provided with a series of flutes to improve the heat exchange and heating of the oven.

Preferably an overheat thermostat is provided in the cooker which can switch off the gas supply to the same in the event of an emergency.

It should therefore be appreciated that the system herein described for heating the heating plates and ovens has been found to allow the heating of the oven to optimum temperature to be achieved within a significantly shorter time than with the conventional heat storage range cooker such as for example the heating of the cooker to the required temperature (i.e. 200° C.) within one hour of being switched on has been found to be achieved. This allows the storage cooker to be provided with the features of pre-programmability inasmuch that the cooker can be programmed to switch on prior to use in a practical fashion so that for example if a person was returning from work and wished to use the cooker upon return, then the cooker can be set to be so switched on. To this end, the cooker can include a programming means to allow the operation of the same to be determined.

In one embodiment the cooker is flueless.

It is envisaged that the invention is of most practical benefit with gas fired cookers whether natural or liquid petroleum gas is used.

A further disadvantage with conventional heat storage range cookers is that the bodies are typically formed from a casting which means that the same are extremely heavy and susceptible to cracking if the strains applied to the same are irregular or in the wrong direction. For this reason it is not possible to fit the same with wheels or rollers which means when the same are installed or moved around a premises they are required to be mounted on wheeled trailers, or in other instances moved over a series of tubular rollers. This is however time consuming, potentially damaging to the cooker and prevents easy movement of the cooker.

In a further aspect of the invention the range cooker is provided with a number of wheels or rollers mounted in a spaced relationship on the underside of the cooker. The wheels are typically mounted at the corners of the underside and typically attached to a steel plate or steel plate portions on the underside of the cooker by any conventional attachment method. The ability to move the cooker using the wheels or rollers means with the steel plate taking up and absorbing any strains due to uneven surfaces without failure means that the cooker can be easily moved into and around premises to the suitable location or locations and can therefore be positioned at a any location where there is a power supply for the control means and a fuel supply.

In a yet further aspect of the present invention there is provided a heat storage range cooker comprising a gas powered heat source which emits heat into a cavity to create a heating gas, said cavity connected to first and second ducts, said first duct directing the gas past first and second heating plates to heat the same, said second duct directing heating gas around at least two sides of a heating oven to heat the same, said first and second ducts having a separate exit or a common exit for the heating gas from the cooker.

In one embodiment the cooker is free standing and allows the escape of the heating gas into the room in which the cooker is located.

BRIEF DESCRIPTION OF THE DRAWINGS

Specific embodiments of the invention will now be described with reference to the accompanying drawings, wherein.

DETAILED DESCRIPTION OF THE INVENTION

Figure 1B:
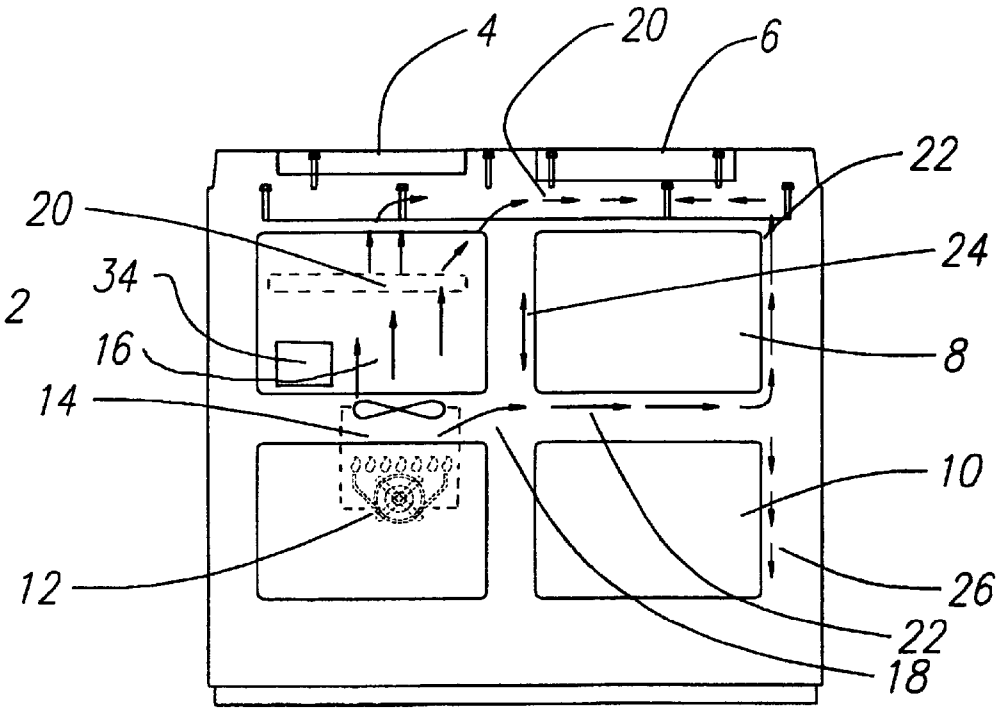
FIGS. 1A and 1B illustrate elevation views of the cooker according to one embodiment of the invention
Figure 1A:
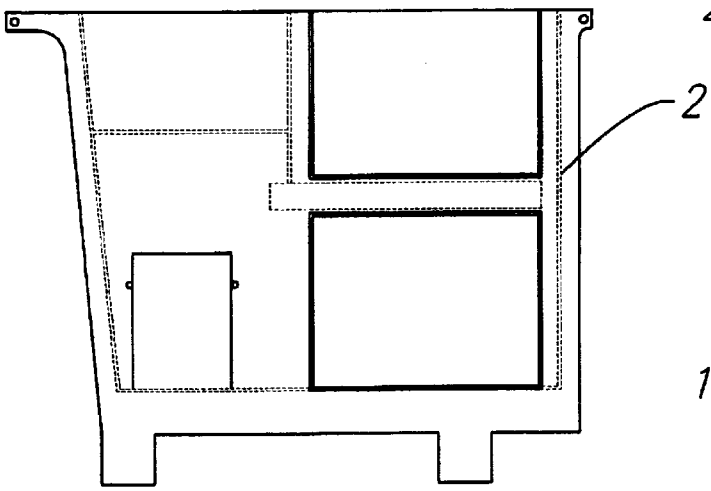

Referring firstly to FIGS. 1A and 1B there is illustrated a cooker body 2 in FIG. 1A and the cooker body fitted with the components which, in combination form one embodiment of the invention. In FIG. 1B there is shown a first heating plate 4, second heating plate, 6 which is cooler, a top oven 8 and lower, cooler oven 10. Also mounted within the body is a heat source in the form of a gas burner 12 which depends into a cavity 14 and into which the heated gas passes when in operation. Leading from the cavity 14 are a first duct 16 which leads to the hot plate 4 and a second duct 18 which leads to the top oven 8.

Referring firstly to the duct 16, the arrows 20 show the passage of some of the heated gas through the duct so that it firstly passes under the hot plate 4 when it is relatively hot and then passes under the cooler hot plate 6 to exit thereafter in a manner which will be described later.

In the second duct 18, the arrows 22 indicate how the heated gas passes along the underside of the oven 8 and how a proportion fills a void 24 on the near side of the oven. The gas then passes along the far side wall of the oven 8 and along a portion of the top side as shown to exit. A portion of the gas can also pass into the void 26 on the far side wall of the lower oven 10 to heat the same to the required temperature.

Figure 2:
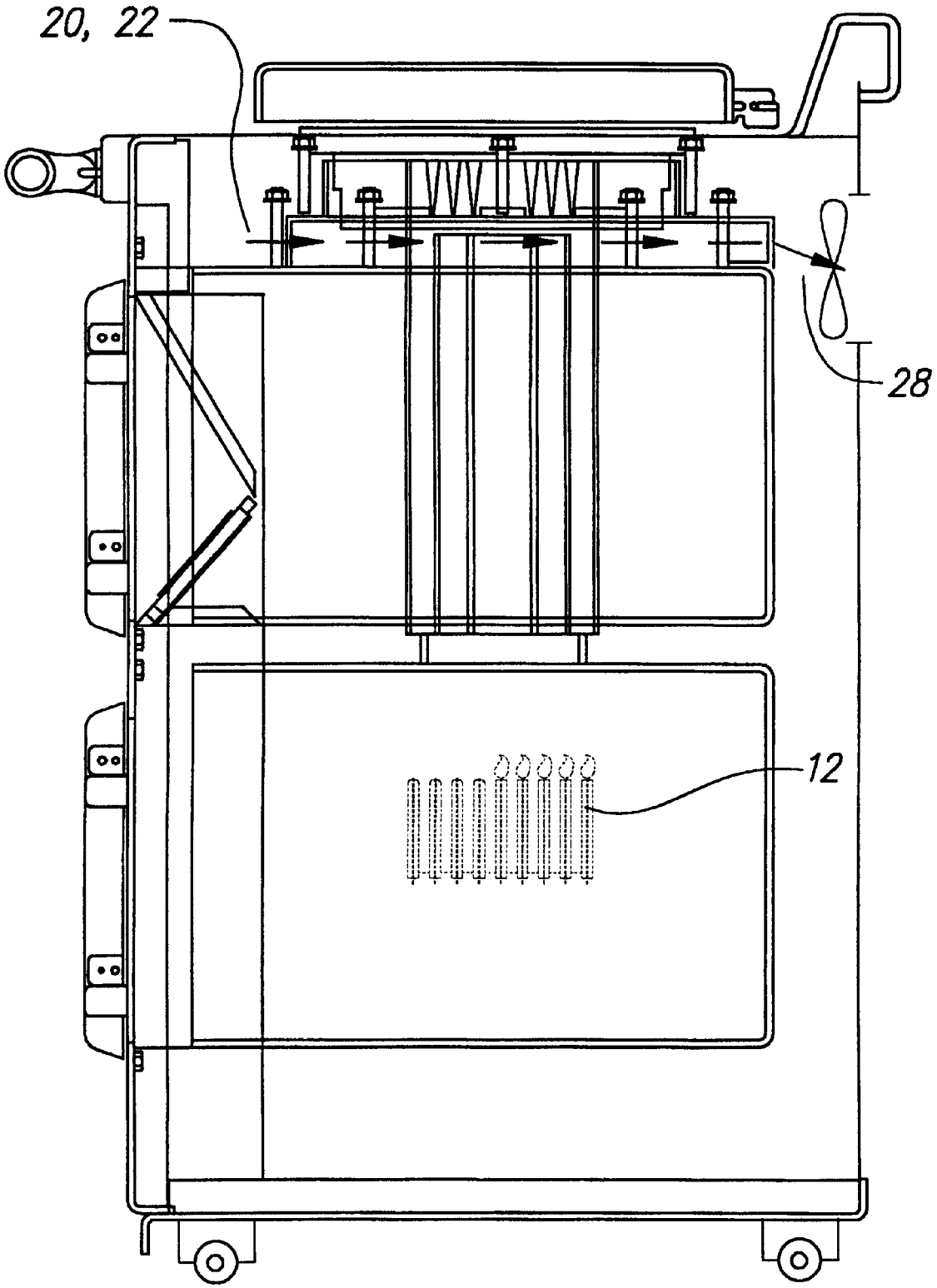
FIG. 2 illustrates a side elevation of the cooker in one embodiment.

To exit, the gases indicated by arrows 20,22 are channelled by respective ducts to a common exit 28 at the rear of the cooker body as indicated in FIG. 2. Typically, a fan, is mounted at or adjacent to the exit which is operated to draw the gases through the ducts to the exit at the required flow and hence create a negative pressure within the ducts. An air inlet can also be provided at or adjacent to the exit to cause a reduction in the heat of the exiting gas and also a slowing effect on the flow rate of the gas through the exit. The gas then exits into the vicinity of the cooker to dissipate. The fan also acts to dilute the products of combustion to below an acceptable level.

Figure 3:
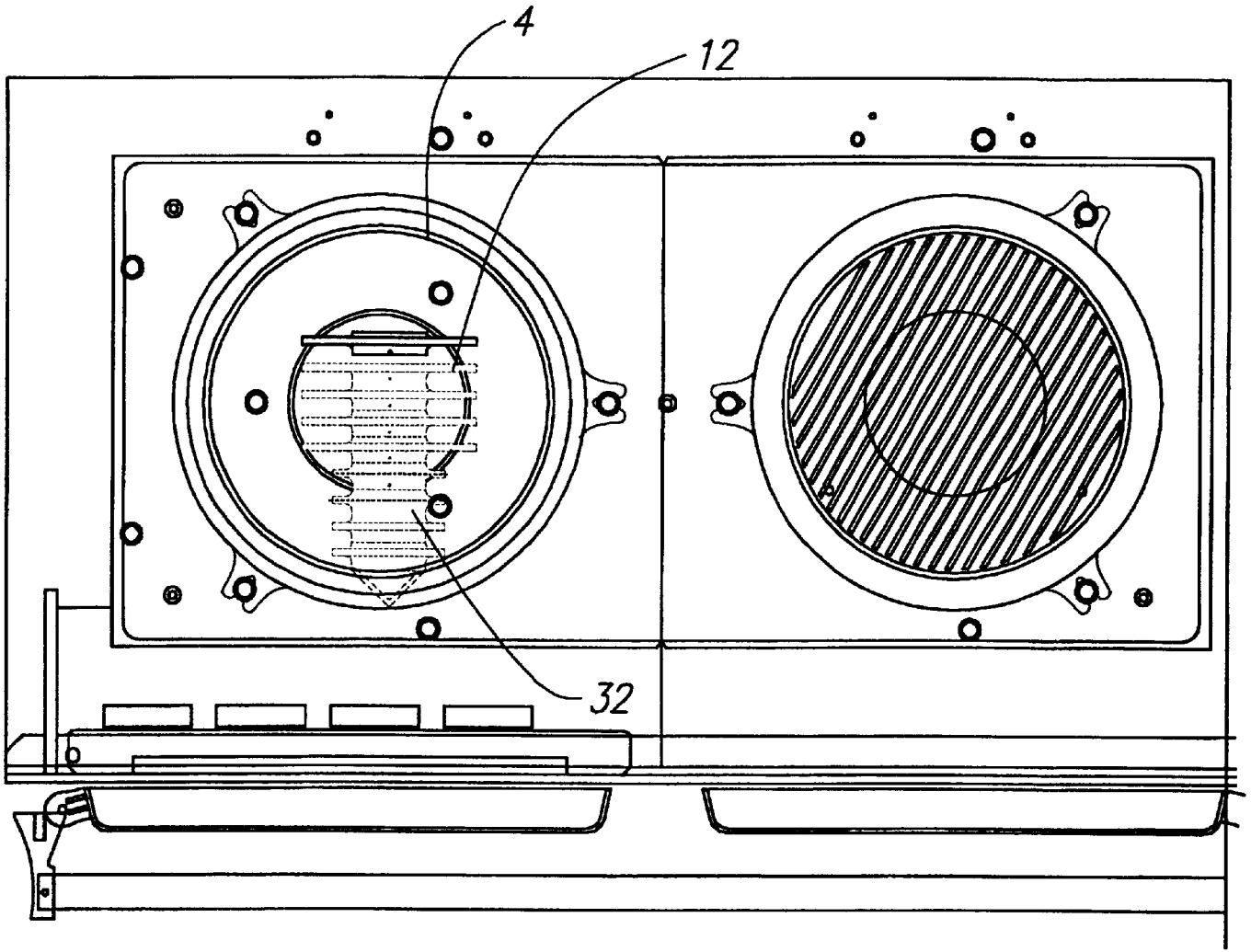
FIG. 3 illustrates a plan view of the cooker in one embodiment.

FIG. 3 illustrates a top view of the cooker and illustrates in a cut off portion of the hot plate 4 how the heat source 12 is positioned relative to the hot plate and how the underside of the hot plate is provided with a series of flutes 32 which are provided to improve heat transfer from the gases onto the hot plate. It is also envisaged, although not shown, that the underside and/or side walls of the oven 8 are provided with flutes to improve the efficiency of heat transfer.

The drawings therefore illustrate how the improved heating of the cooker is achieved by the use of ducts to direct efficiently and effectively the heating gas emitting from the heat source 12. The ducting and exiting of the heating gas from the cooker into the room in which the cooker is housed without the need for a flue means that the position of the cooker can be selected as long as there is a fuel source and a power source for the program controls 34 shown in schematic fashion in FIG. 1B. It is also possible that the cooker may be moved to different positions and so wheels or rollers may be provided on the, typically steel sheet, base of the same to facilitate the movement of the cooker.

Thus it will be appreciated that the invention and the various aspects of the same as herein described provide distinct practical and commercial advantages over the convention heat storage range cookers and allow the same to be used and be adaptable in a manner not previously possible.

What is claimed is:

1. A heat storage range cooker including a heat source mounted at a single location within the cooker which creates a heating gas in a cavity and characterised in that from said cavity there depends a first duct leading directly to a heating plate to channel heat thereto and a second duct leading to a heating oven to channel heat thereto, said heating oven having an underside and sidewalls and wherein said second duct passes along at least the underside and one of the sidewalls of the said heating oven.

2. The heat storage range cooker according to claim 1 characterised in that said ducts and hence the heating gas exit to atmosphere at said cooker.

3. The heat storage range cooker according to claim 1 characterised in that one of the sidewalls is positioned near the heat source and is provided with a passage into which heating gas can pass.

4. The heat storage range cooker according to claim 1 characterised in that the first duct passes to the heating plate and then continues past a second heating plate.

5. The heat storage range cooker according to claim 2 characterised in that the first and second ducts are arranged so as to join together prior to exit from the cooker, so that the heating gas which passes along the ducts exits to atmosphere.

6. The heat storage range cooker according to claim 1 wherein the heating plate has an underside surface and characterised in that the underside surface of the heating plate is provided with at least one flute to aid heat transfer to the heating plate and/or direct gas flow.

7. The heat storage range cooker according to claim 4 comprising a second heating plate having an underside surface and characterised in that the underside surface of the second heating plate is provided with at least one flute to improve heat transfer and/or to direct gas.

8. The heat storage range cooker according to claim 1 characterised in that the first duct leading to the heating plate is formed with a number of flutes to improve heat exchange and/or direct gas flow.

9. The heat storage range cooker according to claim 1 characterised in that the there is provided a fan in connection with said heating duct or ducts, said fan operated to create a flow of the heating gas from the heat source, through the ducts to the exit.

10. The heat storage range cooker according to claim 9 characterised in that the fan is connected to create a negative pressure of gas within the ducts.

11. The heat storage range cooker according to claim 10 characterised in that the fan is located at the location of exit of the heating gas.

12. The heat storage range cooker according to claim 9 characterised in that a positive pressure of gas is created within the ducts by locating the fan at or adjacent to the heat source.

13. The heat storage range cooker according to claim 1 characterised in that prior to the exit of the heating gas from the cooker the same is mixed with air from an air inlet.

14. The heat storage range cooker according to claim 1 characterised in that the side wall and/or the underside of the heating oven is provided with a series of flutes to improve the heat exchange and/or direct the gas flow.

15. The heat storage range cooker according to claim 1 characterised in that the cooker is flueless.

16. The heat storage range cooker according to claim 1 characterised in that the heat source is a gas burner.

17. The heat storage range cooker according to claim 1 characterised in that an overheat thermostat is provided which can switch off the gas supply to the cooker, when the temperature exceeds a predetermined level.

18. The heat storage range cooker according to claim 1 characterised in that programmable controls are provided to control switching the cooker on and off and for heating of the oven prior to use.

19. A heat storage range cooker comprising a gas powdered heat source which emits heat into a cavity to create a heating gas, said cavity connected to first and second ducts, said first duct directing the gas directly past first and second heating plates to heat the same, said second duct directing heating gas around at least two sides of a heating oven to heat the same, said first and second ducts having a separate exit or a common exit for the heating gas from the cooker.

20. The heat storage range cooker according to claim 19 characterised in that said cooker is free standing and allows the escape of the heating gas into the room in which the cooker is located.

21. The heat storage range cooker according to claim 19 characterised in that a number of wheels or rollers are mounted in a spaced relationship on the underside of the cooker.

22. The heat storage range cooker according to claim 21 characterised in that the wheels or rollers are attached to a steel plate or steel plate portions on the underside of the cooker.

* * * * *